US006202226B1

(12) United States Patent
Shoptaugh

(10) Patent No.: US 6,202,226 B1
(45) Date of Patent: Mar. 20, 2001

(54) PORTABLE WASTE ODOR COLLECTION APPARATUS

(76) Inventor: Albert Glenn Shoptaugh, 2085 Paseo Del Oro, Colorado Springs, CO (US) 80904

( * ) Notice: Subject to any disclaimer, the term of this patent is extended or adjusted under 35 U.S.C. 154(b) by 0 days.

(21) Appl. No.: 09/605,748

(22) Filed: Jun. 29, 2000

(51) Int. Cl.[7] ..... E03D 9/04

(52) U.S. Cl. ..... 4/213; 4/347; 4/218; 4/209 R; 4/216; 4/217

(58) Field of Search ..... 4/213, 218, 209 R, 4/210, 211, 216, 217, 347, 348; 454/231, 232, 343

(56) References Cited

U.S. PATENT DOCUMENTS 2,300,109 * 10/1942 Dahlke .
3,691,568 * 9/1972 Martz ..... 4/213
3,733,619 * 5/1973 Smith ..... 4/213
3,942,200 * 3/1976 Pearson ..... 4/213
4,319,366 * 3/1982 Baker, Jr. et al. ..... 4/323
4,882,790 * 11/1989 Ricard ..... 4/213
4,922,557 * 5/1990 Harding et al. ..... 4/347
5,560,048 * 10/1996 Root ..... 4/213

* cited by examiner

*Primary Examiner*—Gregory L. Huson
*Assistant Examiner*—Khoa D. Huynh
(74) *Attorney, Agent, or Firm*—G F. Gallinger

(57) ABSTRACT

A portable apparatus which works in conjunction with an existing ceiling exhaust intake to more directly and selectively intake waste odor emanating either from a bed pan, or from a toilet having a conventionally mounted hinged toilet seat. The waste odor collection apparatus comprises: an upright tube having an upper end portion, a central portion adapted to receive a flexible hose, and a lower portion adapted to seat on a supporting surface; a hood carried by and above the upper portion of the upright tube, adapted to peripherally surround and cover the exhaust intake on the ceiling; and, a first flexible hose having a feed end portion adapted to removably attach to the central portion of the upright tube and a collection end which may be routed proximate to a source of waste odor. Another aspect of this apparatus provides for an odor collection wand which is used in conjunction with the flexible hose connected to the exhaust intake. The wand, without increasing the conventional spacing between the toilet seat and the toilet, can be inserted above the toilet, beneath the toilet seat and between the hinges on the toilet, so that air will be drawn therein from within the toilet bowl.

10 Claims, 1 Drawing Sheet

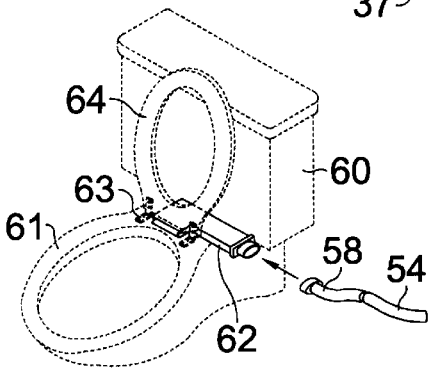
Fig. 4
Fig. 2
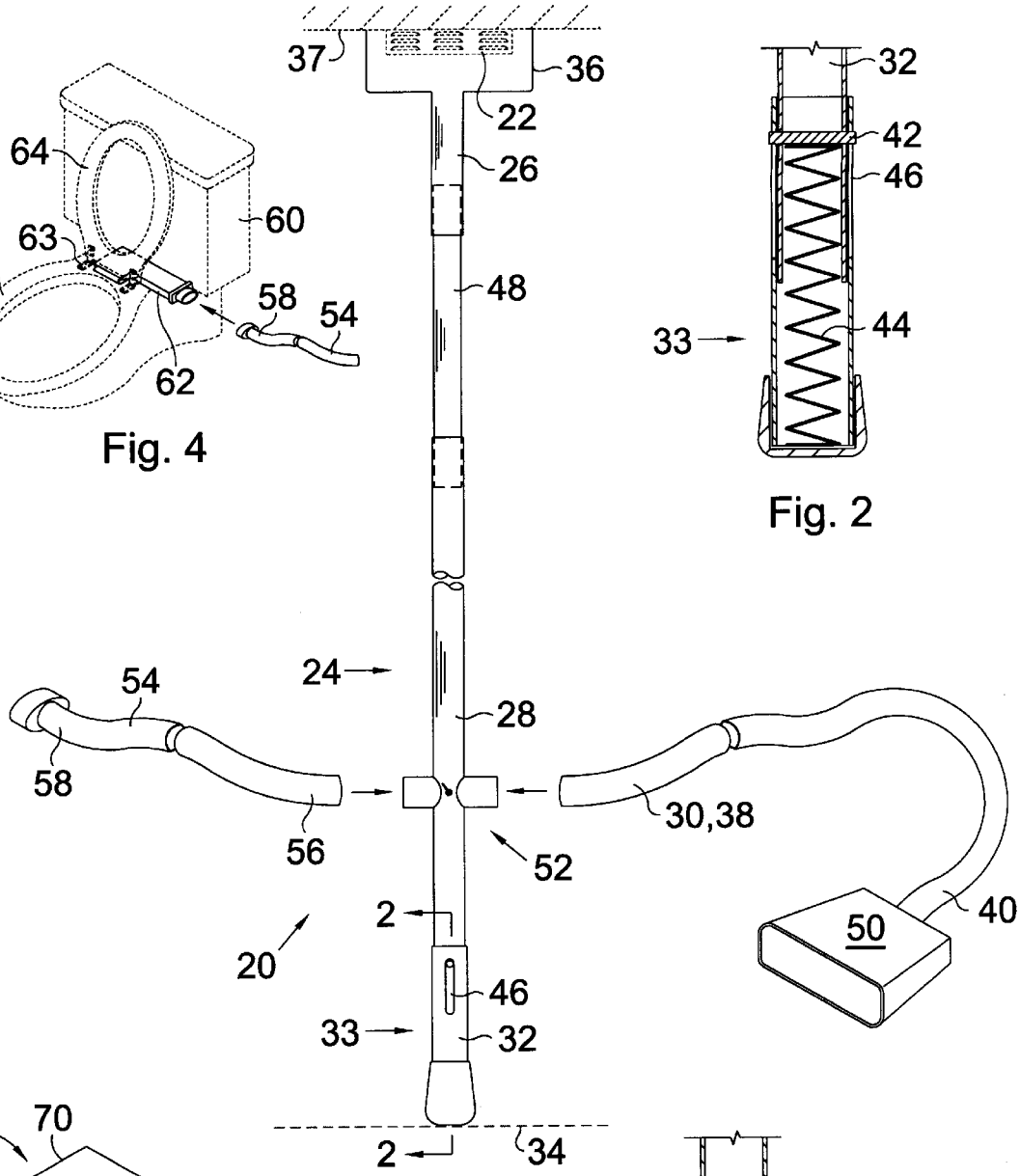
Fig. 1
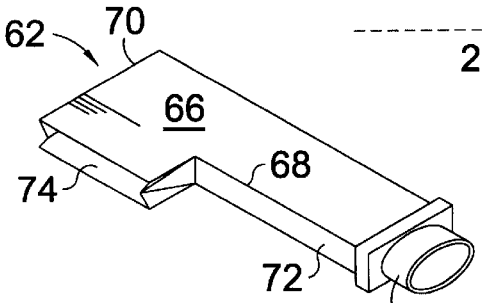
Fig. 5
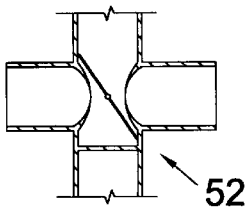
Fig. 3

PORTABLE WASTE ODOR COLLECTION APPARATUS

FIELD OF THE INVENTION

This invention relates to an apparatus for collecting waste odors. More particularly this invention relates to a portable apparatus which works in conjunction with an existing ceiling exhaust intake to more directly and selectively intake waste odor emanating either from a bed pan, or from a toilet having a conventionally mounted hinged toilet seat.

BACKGROUND OF THE INVENTION

There is a real unsatisfied need in hospitals and nursing homes for an apparatus for collecting waste odors emanating from bed pans. These odors are unpleasant for both patients and staff. Although these waste odors are not common with most patients, their incidence with particular patients is common and severe. What is needed is a portable apparatus which could be moved from room to room where needed. Such an apparatus should be able to be used in existing conventionally designed hospital and nursing home facilities.

There is also a real unsatisfied need particularly in hospitals and nursing homes for a portable apparatus which could be added to existing toilet facilities to better and more directly ventilate odors from those toilets. It would be particularly desirable if such an apparatus could be used in conjunction with an existing toilet having a conventionally mounted seat. Most apparatuses used to better and more directly ventilate odors from existing toilets mandate that the seat of the toilet be raised on its hinges. Not only does this require a relatively substantial and expensive intake ring which is positioned beneath the toilet seat (such a ring must support a full user's weight), but it also requires the mounting of the ring and the consequent sub-optimal height of the toilet seat.

OBJECTS OF THE INVENTION

It is an object of this invention to disclose an apparatus for collecting waste odors emanating from bed pans. It is an object of this invention to disclose a portable apparatus which could be moved by staff, from room to room in hospitals and nursing homes, without any need for installation tools to where needed. It is an object of this invention to disclose a portable apparatus which could be able to be used in existing conventionally designed hospital and nursing home facilities. It is yet a further object of this invention to disclose a portable apparatus which could be added to existing toilet facilities to better and more directly ventilate odors from those toilets. It is a final object of this invention to disclose an apparatus which can better and more directly ventilate odors from existing toilets without requiring that the seat of the toilet be raised on its hinges. Such an apparatus would not only be relatively inexpensive but really portable. It also could be used on existing toilets without changing the seat height to a sub optimal height.

One aspect of this invention provides for a portable apparatus which works in conjunction with an existing ceiling exhaust intake to more directly and selectively intake waste odor emanating either from a bed pan, or from a toilet having a conventionally mounted hinged toilet seat. The waste odor collection apparatus comprises: an upright tube having an upper end portion, a central portion adapted to receive a flexible hose, and a lower portion adapted to seat on a supporting surface; a hood carried by and above the upper portion of the upright tube is adapted to peripherally surround and cover the exhaust intake on the ceiling. A first flexible hose having a feed end portion is adapted to removably attach to the central portion of the upright tube. The hose has a collection end which may be routed proximate to a source of waste odor.

Another aspect of this apparatus comprises an odor collection wand which is adapted to be positioned beneath a rear portion between the hinges on a conventionally mounted toilet seat on a toilet. It is used in conjunction with a flexible hose connected to an exhaust intake. The odor collection wand comprises: a similarly shaped upper and lower L shaped members, each member generally having interior and exterior L shaped peripheral edges. The members are connected and spaced along their interior and exterior peripheral L shaped edges in a generally planar orientation by a continuous edge spacer. The members are adapted to intake odors on one end between their interior and exterior L shaped edges, and adapted to receive the flexible vacuum hose on their opposite end portion between their interior and exterior L shaped edges. This enables an intake end portion of the wand, without increasing the conventional spacing between the toilet seat and the toilet, to be inserted above the toilet bowl, beneath the toilet seat and between the hinges on the toilet, so that when the flexible vacuum hose is connected thereto air will be drawn therein from inside the toilet bowl. In a preferred aspect of this invention the edge spacer allows an intake end portion of the two L shaped members to move together if so squeezed together between the hinged toilet seat and the toilet bowl.

Various other objects, advantages and features of this invention will become apparent to those skilled in the art from the following description in conjunction with the accompanying drawings.

FIGURES OF THE INVENTION

FIG. 1 is a perspective view of a portable waste collection apparatus.

FIG. 2 is a cross sectional view of a resilient longitudinally compressible portion of the portable waste collection apparatus as viewed along line 2—2 on FIG. 1.

FIG. 3 is a cross sectional view of a two way valve shown in FIG. 2.

FIG. 4 is a perspective view showing the collection end portion of the second hose connected to a collection wand positioned on a toilet.

FIG. 5 is a perspective view of an odor collection wand adapted for use with a toilet.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a portable waste collection apparatus 20. The portable waste odor collection apparatus 20 more directly and selectively intakes waste odor and routes that odor to an existing ceiling exhaust intake 22. The apparatus 20 comprises: an upright tube 24 having an upper end portion 26, a central portion 28 adapted to receive a first flexible hose 30, and a lower portion 32 adapted to seat on a supporting surface 34. A hood 36 carried by and above the upper portion of the upright tube 26 is adapted to peripherally surround and cover the exhaust intake 36 on the ceiling 37. The first flexible hose 30 has a feed end portion 38 adapted to removably attach to the central portion 28 of the upright tube 24 and a collection end portion 40 which may be routed proximate to a source of waste odor (not shown). Waste odor emanating therefrom will be routed through the flexible hose 30 into the upright tube 24, and then there along through the hood 36 and into the existing ceiling exhaust intake 22.

The upright tube 24 has a resilient longitudinally compressible portion 33 so that the tube 24 may be longitudinally compressed to place it, and then maintain it, in operable position. FIG. 2 is a cross sectional view of a resilient longitudinally compressible portion 33 of the portable waste collection apparatus 20 as viewed along line 2—2 on FIG. 1. Most preferably the lower portion 32 of the upright tube 24 comprises the longitudinally compressible portion 33. Most preferably the longitudinally compressible portion 33 comprises a pin 42, a spring 44, and an axial elongate opening 46 in the tube 24.

Most preferably the upright tube 24 comprises a section 48 which may be added and removed to accommodate varying ceiling 37 and upright tube 24 height requirements. Most preferably the the apparatus 20 further comprises a flattened funnel end piece 50 having a rear end portion adapted for connection to the collection end portion 50 of the flexible hose 30 so that it may be better positioned and anchored adjacent to a patient on a bed (not shown). It is contemplated that the flattened funnel end piece 50 would be positioned under bed coverings (not shown) adjacent to a bed pan (not shown).

In a preferred embodiment of the invention the central portion 28 of the upright tube 24 further comprises a two way valve 52 and a second hose 54 having a discharge end portion 56 connected to the two way valve 52 and an intake end portion 58. FIG. 3 is a cross sectional view of a two way valve 52 shown in FIG. 2. FIG. 4 is a perspective view showing the collection end portion 58 of the second hose 54 connected to a collection wand 62 positioned on a toilet 60. The intake end portion 58 of the second hose 54 is routed to a collection wand 62 which is positioned on the toilet bowl 61 of the toilet 60. With this arrangement the two way valve 52 can be used to select the exhaust intake between the first flexible hose 30 routed to a patient on a bed (neither shown) or to the second hose 54 routed to the toilet 60.

FIG. 5 is a perspective view of an odor collection wand 62 adapted for use with a toilet 60. The odor collection wand 60 is adapted to be positioned beneath a rear portion of the toilet 60 between the hinges 63 on a conventionally mounted toilet seat 64 on a toilet 60. It is used in conjunction with flexible hose 54 connected to an exhaust intake 22. The odor collection wand 62 comprises: similarly shaped upper and lower L shaped members 66, each member 66 generally having an interior L shaped peripheral edge 68 and an exterior L shaped peripheral edge 70; The members 66 are connected and spaced along their interior 68 and exterior 70 peripheral L shaped edges in a generally planar orientation by a continuous edge spacer 72. The odor collection wand 66 is adapted to intake odors on one end 74 between their interior and exterior L shaped edges, and adapted to receive the flexible vacuum hose 54 on their opposite end portion 76 between their interior 68 and exterior 70 L shaped edges. An intake end portion 74 of the wand 66, without increasing the conventional spacing between the toilet 64 seat and the toilet 60, may be inserted above the toilet bowl 61, beneath the seat 64 and between the hinges 63 on the toilet 60, so that when the flexible vacuum hose 54 is connected thereto air will be drawn from inside the toilet bowl 61.

In the most preferred embodiment of the collection wand 66 the edge spacer 72 thereof allows an intake end portion 74 of the two L shaped members 66 to move together if so squeezed together between the hinged toilet seat 64 and the toilet 60.

Most preferably the first and second flexible hoses 30,54 are 1½" in diameter and longitudinally expandable like a vacuum cleaner hose.

While the invention has been described with preferred specific embodiments thereof, it will be understood that this description is intended to illustrate and not to limit the scope of the invention, which is defined by the following claims.

I claim:

1. A portable waste odor collection apparatus adapted to more directly and selectively intake a source of waste odor and route that odor to an existing ceiling exhaust intake comprising:

an upright tube having an upper end portion, a central portion adapted to receive a flexible hose, and a lower portion adapted to seat on a supporting surface;

a hood carried by and above the upper portion of the upright tube, adapted to peripherally surround and cover the exhaust intake on the ceiling; and, a first flexible hose having a feed end portion adapted to removably attach to the central portion of the upright tube and a collection end portion which may be routed proximate to a source of waste odor;

so that waste odor emanating from the source thereof will be routed through the flexible hose into the upright tube, and then therealong through the hood and into the existing ceiling exhaust intake.

2. An apparatus as in claim 1 wherein the upright tube has a resilient longitudinally compressible portion so that the tube may be longitudinally compressed to place it, and then maintain it, in operable position.

3. An apparatus as in claim 2 wherein the lower portion of the upright tube comprises the longitudinally compressible portion and wherein the longitudinally compressible portion comprises a spring.

4. An apparatus as in claim 3 wherein the longitudinally compressible portion further comprises a pin, and an axial elongate opening in the tube.

5. An apparatus as in claim 3 wherein the upright tube comprises a section which may be added and removed to accommodate varying ceiling and upright tube height requirements.

6. An apparatus as in claim 5 further comprising a flattened funnel end piece having a rear end portion adapted for connection to the collection end of the flexible hose so that the collection end of the hose may be better positioned and anchored adjacent to a patient on a bed.

7. An apparatus as in claim 5 wherein the central portion of the upright tube further comprises a two way valve and a second hose having a discharge end portion connected to the two way valve and a toilet intake end portion, so that the exhaust intake may be selected between the first flexible hose routed to a patient on a bed or the second hose having the toilet intake end portion.

8. An apparatus as in claim 7 for use with a toilet having a toilet bowl, hinges, and a conventionally mounted toilet seat, further comprising a generally L shaped odor collection wand adapted to be positioned between the hinges on the toilet seat, said wand having one end portion adapted to be positioned between the hinges and under the toilet seat, and the other opposite end portion adapted to receive the second hose.

9. An apparatus as in claim 8 wherein the wand comprises similarly shaped upper and lower L shaped members, each member generally having interior and exterior L shaped peripheral edges;

said members connected and spaced along their interior and exterior peripheral L shaped edges in a generally planar orientation by a continuous edge spacer;

said members adapted to intake odors on one intake end portion between the interior and exterior L shaped edges, and adapted to receive the hose on their opposite end portion between the interior and exterior L shaped edges;

so that an intake end portion of the wand may, without increasing the conventional spacing between the toilet seat and the toilet, be inserted above the toilet bowl, beneath the toilet seat and between the hinges on the toilet, so that when the second hose is connected thereto air will be drawn therein from within the toilet bowl.

10. An apparatus as in claim 9 wherein the edge spacer allows an intake end portion of the two L shaped members to move together if so squeezed together between the hinged toilet seat and the toilet bowl.

* * * * *